US006701902B2

(12) United States Patent
Koyama et al.

(10) Patent No.: US 6,701,902 B2
(45) Date of Patent: Mar. 9, 2004

(54) ACTIVATED CARBON CANISTER

(75) Inventors: Nobuhiko Koyama, Nagoya (JP); Masao Kano, Gamagori (JP); Noriyasu Amano, Gamagori (JP); Hideaki Itakura, Okazaki (JP); Susumu Abe, Kobe (JP)

(73) Assignees: Denso Corporation, Kariya (JP); Nippon Soken, Inc., Nishio (JP); Kuraray Chemical Co., Ltd., Osaka (JP)

( * ) Notice: Subject to any disclaimer, the term of this patent is extended or adjusted under 35 U.S.C. 154(b) by 0 days.

(21) Appl. No.: 10/186,729

(22) Filed: Jul. 2, 2002

(65) Prior Publication Data

US 2003/0005912 A1 Jan. 9, 2003

(30) Foreign Application Priority Data

Jul. 3, 2001 (JP) ..... 2001-202373

(51) Int. Cl.[7] ..... F02M 37/04
(52) U.S. Cl. ..... 123/519; 123/518; 55/282.2
(58) Field of Search ..... 123/516, 518, 123/519; 55/282.2

(56) References Cited

U.S. PATENT DOCUMENTS

| | | | | | |
|---|---|---|---|---|---|
| 5,021,071 | A | * | 6/1991 | Reddy | 123/518 |
| 5,238,470 | A | * | 8/1993 | Tolles et al. | 123/519 |
| 5,304,527 | A | * | 4/1994 | Dinitri | 502/425 |
| 5,408,976 | A | * | 4/1995 | Reddy | 123/519 |
| 5,981,930 | A | | 11/1999 | Inoue et al. | |
| 2002/0162457 | A1 | * | 11/2002 | Hydo et al. | 123/519 |

FOREIGN PATENT DOCUMENTS

| | | |
|---|---|---|
| JP | 60-6061 | 1/1985 |
| JP | 2-13161 | 1/1990 |
| JP | 5-21158 | 3/1993 |
| JP | 5-76754 | 3/1993 |

* cited by examiner

*Primary Examiner*—Thomas N. Moulis
(74) *Attorney, Agent, or Firm*—Nixon & Vanderhye P.C.

(57) ABSTRACT

A canister for a vehicular evaporative emission control system has activated carbon and heating means. The heating means heats the activated carbon particles. The activated carbon particles are characterized by the following properties. Pore volume is 0.28 ml/ml or more. Average pore radius is in a range of 10.5 Angstroms to 12.0 Angstroms. Particle diameter of the activated carbon is in a range of 1.0 mm to 1.6 mm. The activated carbon particles provide high performances on both of adsorption and desorption.

6 Claims, 6 Drawing Sheets

ACTIVATED CARBON CANISTER

CROSS REFERENCE TO RELATED APPLICATION

This application is based on Japanese Patent Application No. 2001-202373 filed on Jul. 3, 2001 the contents of which are incorporated herein by reference.

BACKGROUND OF THE INVENTION

1. Field of the Invention

The present invention relates to a canister that has activated carbon as adsorption material and a heater for heating the activated carbon. The canister is preferable for an evaporative emission control system for vehicle.

2. Description of Related Art

In a vehicular evaporative emission control system, a canister containing activated carbon is used for adsorbing fuel vapor. The canister is communicated with a fuel tank via a vapor line. The canister is arranged to be able to communicate with atmosphere for introducing purge air when the canister is desorbed. The canister is also communicated with an intake passage of an engine via a purge line. A purge valve is disposed on the purge line.

The activated carbon for the canister has average pore radius in a range of about 12.0 Angstroms to 14.0 Angstroms, and particle diameter in a range of about 1.6 mm (millimeter) to 3.0 mm. The canister further comprises means for heating the activated carbon for desorption. Such a heating technique is effective to enhance adsorption and desorption performances of the activated carbon. JP-U-5-21158, JP-A-60-6061, and JP-U-2-13161 disclose canisters that have heater means.

However, adsorption performance of the conventional canister is not enough to satisfy several requirements, because the conventional activated carbon has relatively large average pore radius. The adsorption performance can be lowered due to a residual heat, because the activated carbon has relatively large particle size and has less heat conductance.

SUMMARY OF THE INVENTION

It is an object of the present invention to provide a canister that has improved adsorption and desorption performances.

According to a first aspect of the present invention, the canister has a heating means that heats activated carbon particles when desorption. The activated carbon particles have pore volume of 0.28 ml/ml (milliliters/milliliter) or more. The activated carbon particles have average pore radius in a range of 10.5 Angstroms to 12.0 Angstroms. The pore volume and the average pore radius are measured by the nitrogen adsorption Cranston-Inkley method.

The activated carbon particles obtain high adsorption performance since the pore volume is 0.28 ml/ml or more and the average pore radius is relatively small in a range of 10.5 Angstroms to 12.0 Angstroms. The pore volume of 0.28 ml/ml or more is needed to provide high adsorption performance.

FIG. 7 is a graph showing n-butane working capacities at 25° C. (Celsius degrees), 50° C., 75° C. and 100° C. versus average pore radius. The n-butane working capacities are measured under the following conditions, a canister capacity is 847 ml (milliliters), adsorption are carried out up to 0.3 vol % (volume percentages) breakthrough under 100% (percentages) n-butane gas atmosphere, desorption are carried out under purge air amount of 200 Bed volume and flow rate of 101/min (liter/minutes), and the plotted data are average values of adsorption amount and desorption amount measured in fifth and sixth cycles out of six cycles of adsorption and desorption. The graph shows that the activated carbon particles having average pore radius of 10.5 Angstroms to 12.0 Angstroms provide greater working capacities than that of the activated carbon particles having average pore radius of 12.0 Angstroms or more. In FIG. 7, the activated carbon in a range RWH performs effectively when it is used with heating means. A range RNH indicates the activated carbon in case of no heater.

Although the desorption performance at normal temperatures is not high enough since the activated carbon particles have relatively small average pore radius which is in a range of 10.5 Angstroms to 12.0 Angstroms, it is possible to enhance the desorption performance by utilizing heating means for heating the activated carbon particles when desorption.

The activated carbon particles may have particle size in a range of 1.0 mm to 1.6 mm. The particle size may be defined by diameter of particles. It is possible to provide high adsorption performance. The activated carbon particles having smaller particle diameter than 1.0 mm may cause excessive pressure loss. It is possible to provide good heat conduction since it is possible to reduce gaps between the activated carbon particles. Therefore, it is possible to prevent lowering of the adsorption performance due to residual heat, because temperature of the activated carbon particles can be rapidly decreased after desorption with heating.

FIG. 8 shows refueling working capacities of activated carbon pellets and crushed activated carbon particles versus particle size. The refueling working capacities are measured under the following conditions, a canister capacity is 2000 ml (milliliters), adsorption is carried out at 25° C. (Celsius degrees) constant up to 0.3 vol % (volume percentages) breakthrough when refueling a fuel tank of 80 liters, desorption is carried out at 25° C. (Celsius degrees) under purge air amount of 450 Bed volume and flow rate of 201/min (liters/minute), and the plotted data are average values of adsorption amount and desorption amount measured in fifth cycle and sixth cycle out of six cycles of adsorption and desorption. The graph shows that the activated carbon having particle diameter of 1.6 mm or less provide greater working capacities than that of the activated carbon having particle diameter larger than 1.6 mm. In FIG. 8, the activated carbon in a range RIN performs effectively when it is used with heating means. A range RPA indicates the activated carbon in case of no heater.

The canister may be used for an evaporative emission control system for adsorbing and desorbing fuel vapor such as gasoline vapor. For instance, the canister adsorbs fuel vapor from a fuel tank. The heating means is deactivated and a purge valve disposed on a purge line is closed during adsorption. The canister desorbs fuel vapor by heating and purging. The adsorbed fuel vapor is purged into an intake passage of an engine when the engine is running and a negative pressure is available in the intake passage. The purge valve is opened to permit purging airflow from the canister to the intake passage. The heating means is activated to enhance desorption of the fuel vapor.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Figure 1:
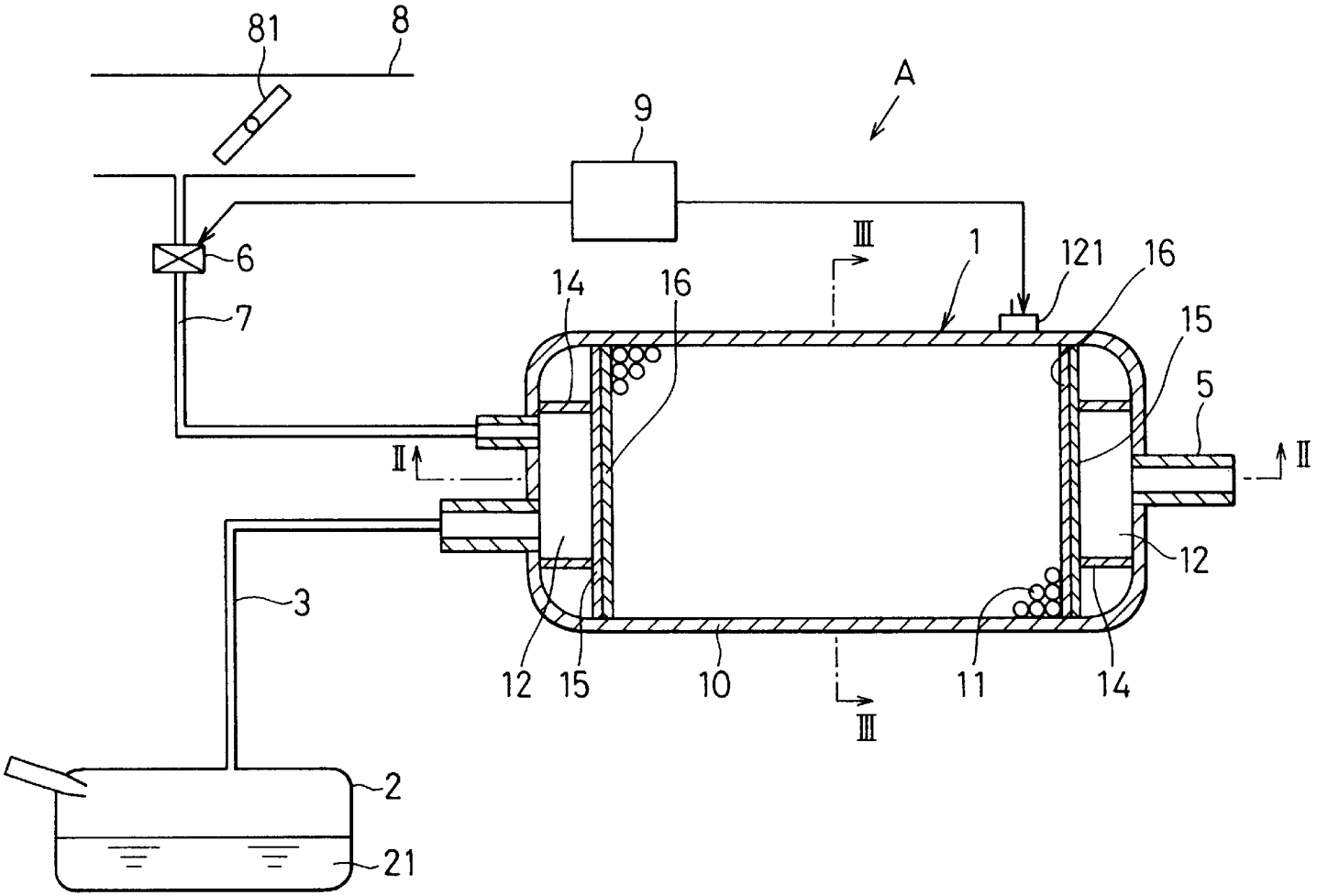
FIG. 1 is a schematic diagram showing an evaporative emission control system having a canister according to a first embodiment of the present invention.

An embodiment of the present invention will be explained with reference to the drawings. FIG. 1 shows a vehicular evaporative emission control system A. A canister 1 contains activated carbon particles 11 adsorptive of fuel vapor.

A first end portion of the canister 1 is communicated with a fuel tank 2 via a vapor line 3. The fuel tank 2 contains fuel 21 such as gasoline. The first end portion of the canister 1 is also communicated with an intake passage 8 of an engine via a purge line 7 that has a purge valve 6. The opposite second end portion of the canister 1 is arranged to be communicated with atmosphere to introduce atmospheric air as purge air via a vent line 5. Therefore the purge air is drawn into the canister 1 from the vent line 5.

Figure 2:
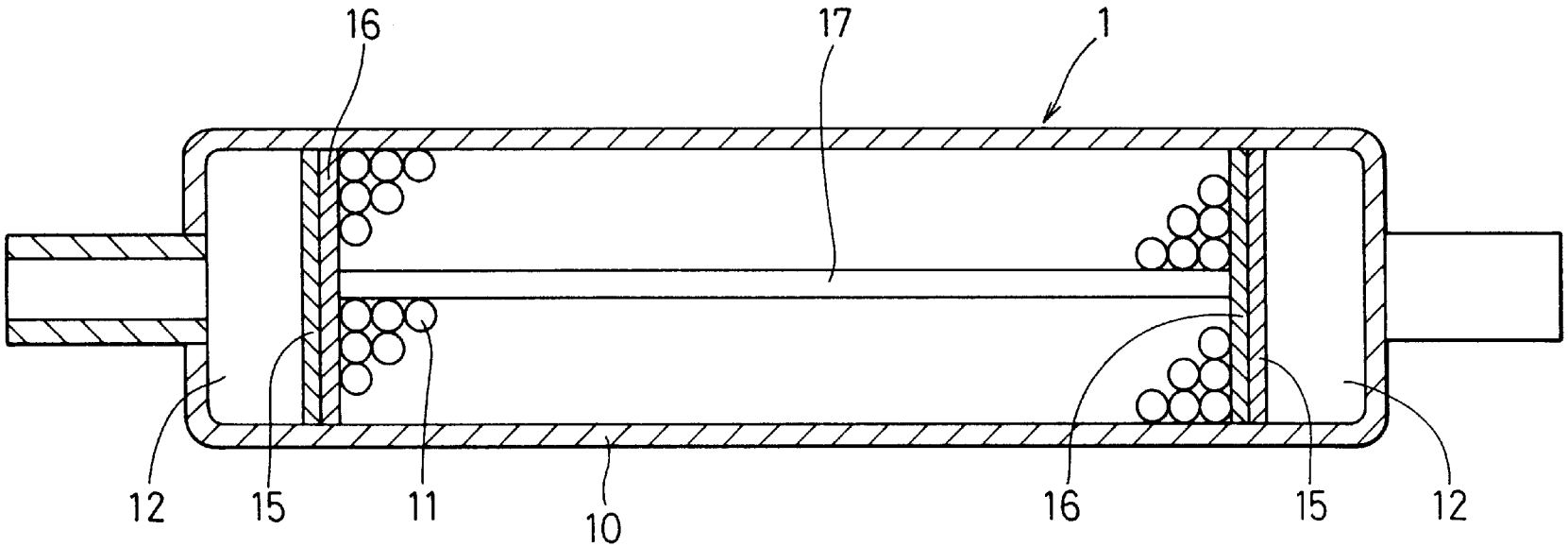
FIG. 2 is a cross-sectional view showing a cross section taken along II—II of FIG. 1.
Figure 3:
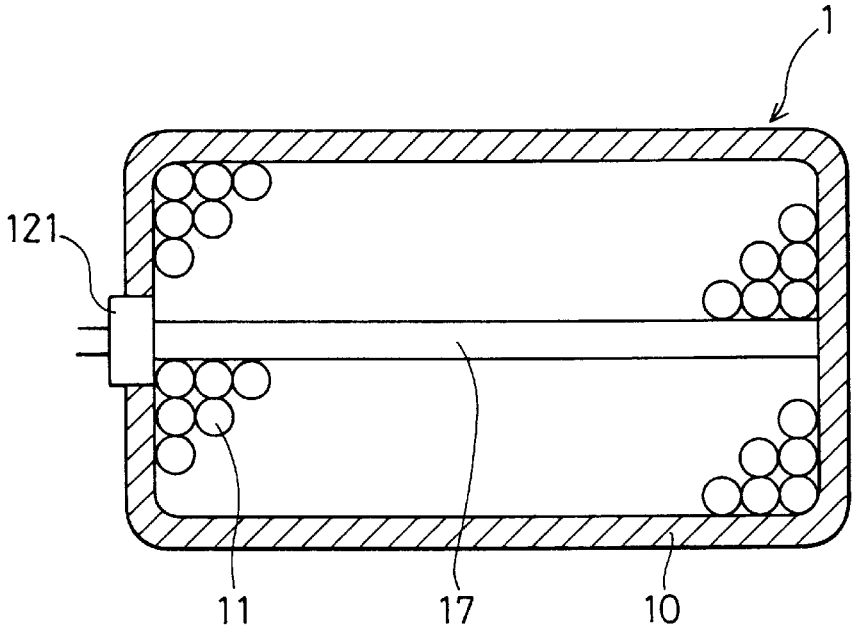
FIG. 3 is a cross-sectional view showing a cross section taken along III—III of FIG. 1.
Figure 4:
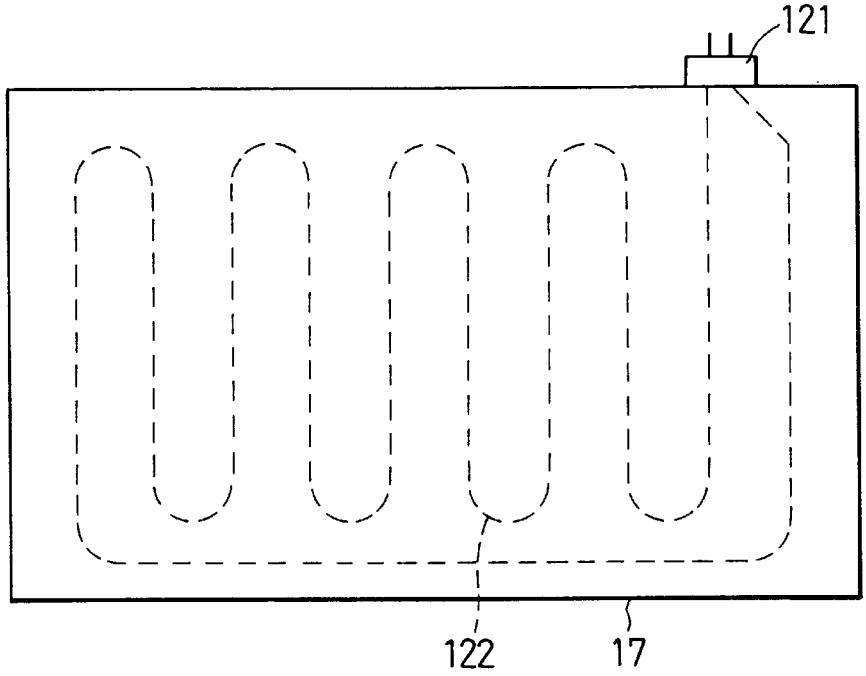
FIG. 4 is a plane view showing an electric heater according to the first embodiment of the present invention.

FIG. 2 shows a cross-section taken along II—II line of FIG. 1. FIG. 3 shows a cross-section taken along III—III line of FIG. 1. The activated carbon particles 11 are contained in a middle of a flat rectangular shaped canister container 10. Porous plates 15 and filters 16 are disposed on both sides of the activated carbon layer respectively. The canister container 10 defines cavities 12 and 12 on both ends thereof. Springs 14 and 14 are disposed in the cavities 12 and 12 respectively, for urging the porous plates 15 and the filters 16 toward inside.

An electric heater 17 as a heating means is disposed in the canister container 10 as shown in FIGS. 2 and 3. The electric heater 17 is formed into a plate shape and is disposed to separate the activated carbon particles 11 into two layers. The electric heater 17 is disposed in the canister container 10 parallel to a flow direction of fuel vapor. The electric heater 17 has a heating wire 122. A connector 121 is disposed on a side of the canister container 10 for supplying power to the electric heater 17. The electric heater 17 is activated for heating the activated carbon particles 11 when desorption. The electric heater 17 heats the activated carbon particles 11 up to about 40° C. to about 150° C. The heating means may be formed into a plurality of heating plates or the like. Supplying electric current directly to the activated carbon particles may provide the heating means. The heating means may also be provided by a hot water passage or the like.

A throttle valve 81 operatively connected with an accelerator pedal is disposed in the intake passage 8 in which air filtered by an air cleaner flow to combustion chambers of the engine.

Figure 5:
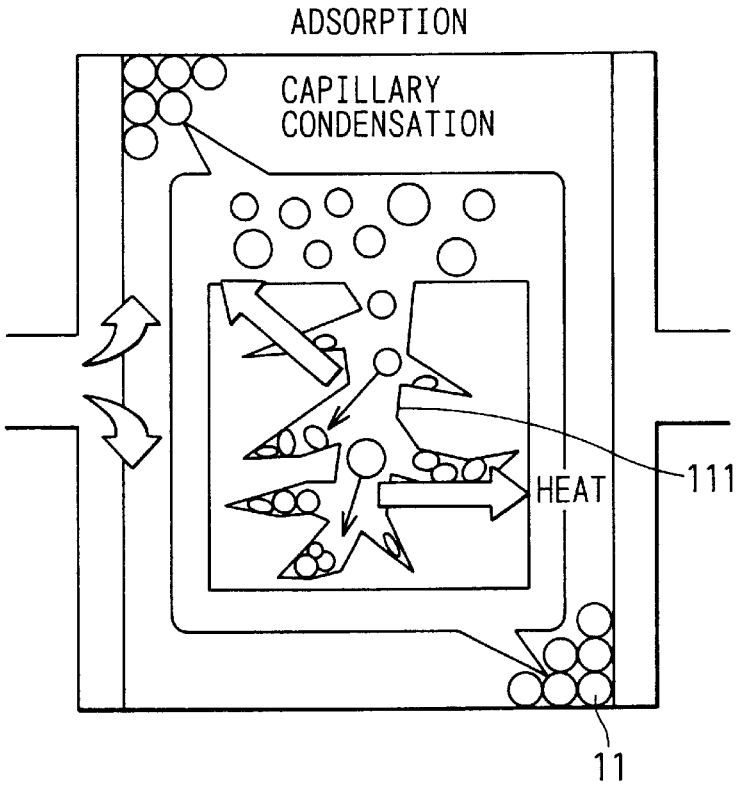
FIG. 5 is a schematic diagram showing behavior of fuel vapor in pore of activated carbon.

A controller 9 controls the purge valve 6 and the electric heater 17. When the engine is stopped, that is the canister 1 adsorbs fuel vapor form the fuel tank 2, the electric heater 17 is deactivated and the purge valve 6 is closed. The fuel vapor flows into the canister 1, and is adsorbed on the activated carbon particles 11 as shown in FIG. 5. When the fuel vapor enters into a pore 111 of the activated carbon particles 11, the pore 111 generates a capillary condensation. Meanwhile, the fuel vapor is condensed and adsorbed on the pore 111. Therefore, heat of adsorption is generated and heats the activated carbon particles 11.

Figure 6:
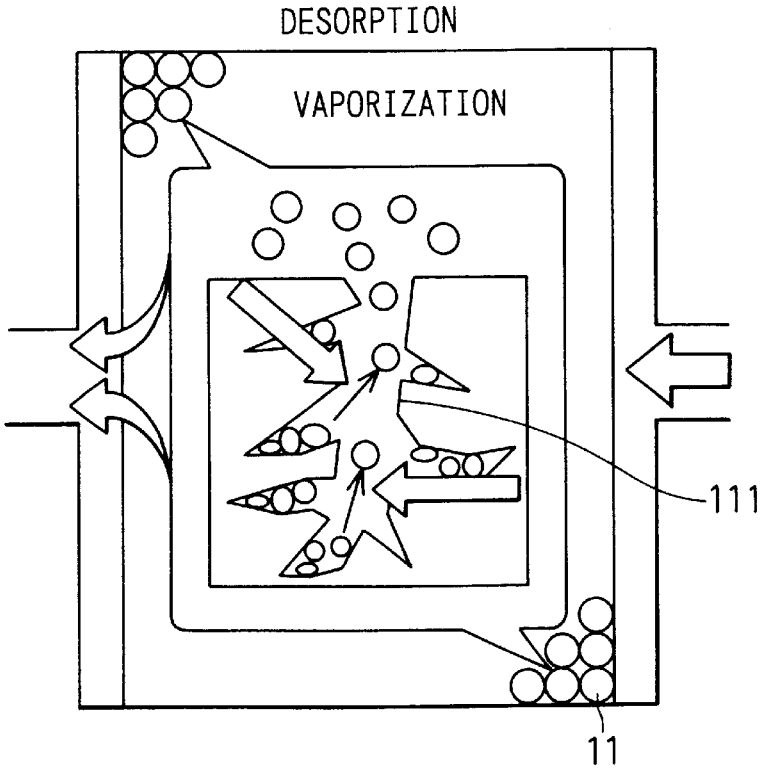
FIG. 6 is a schematic diagram showing behavior of fuel vapor in pore of activated carbon.
Figure 7:
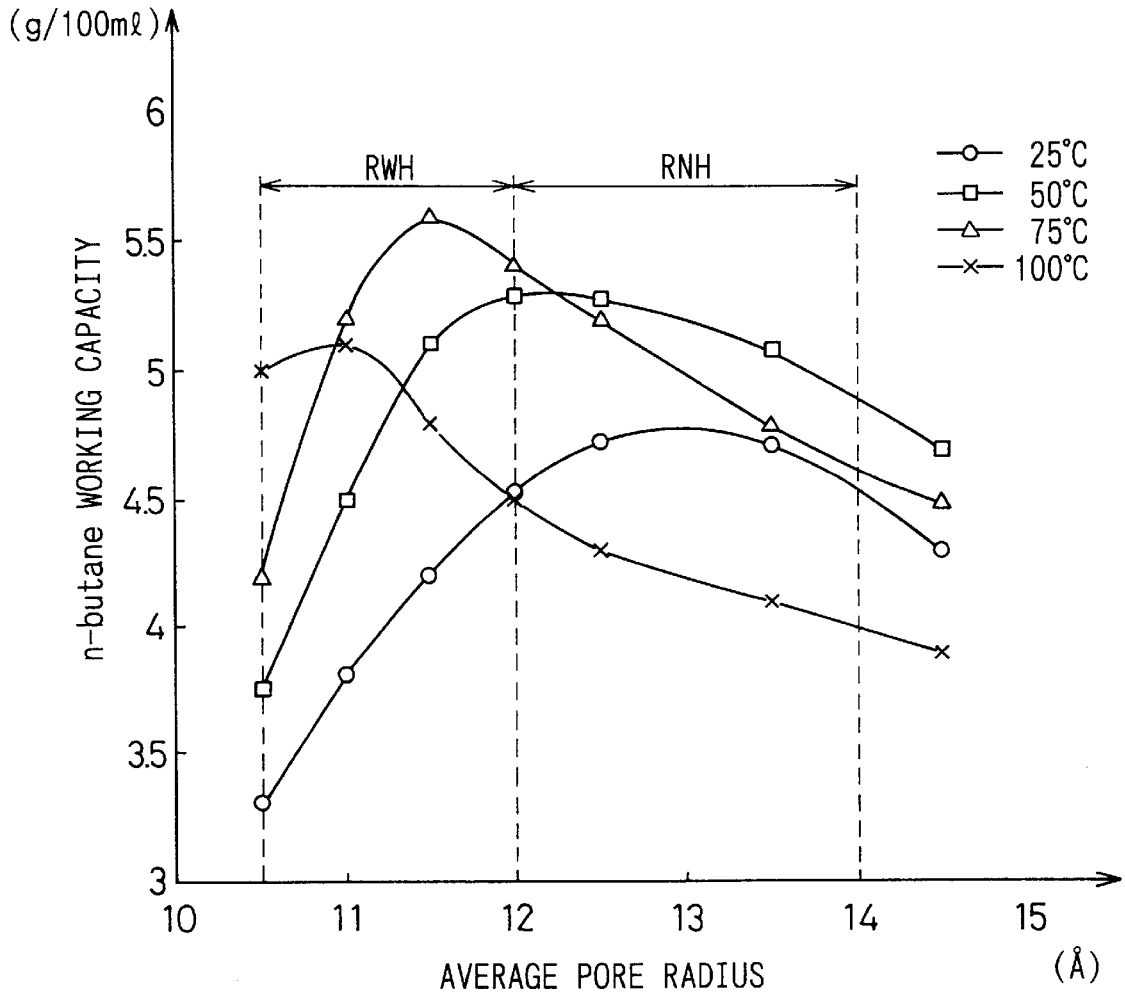
FIG. 7 is a graph showing n-butane working capacities at several temperatures with respect to average pore size of activated carbon.
Figure 8:
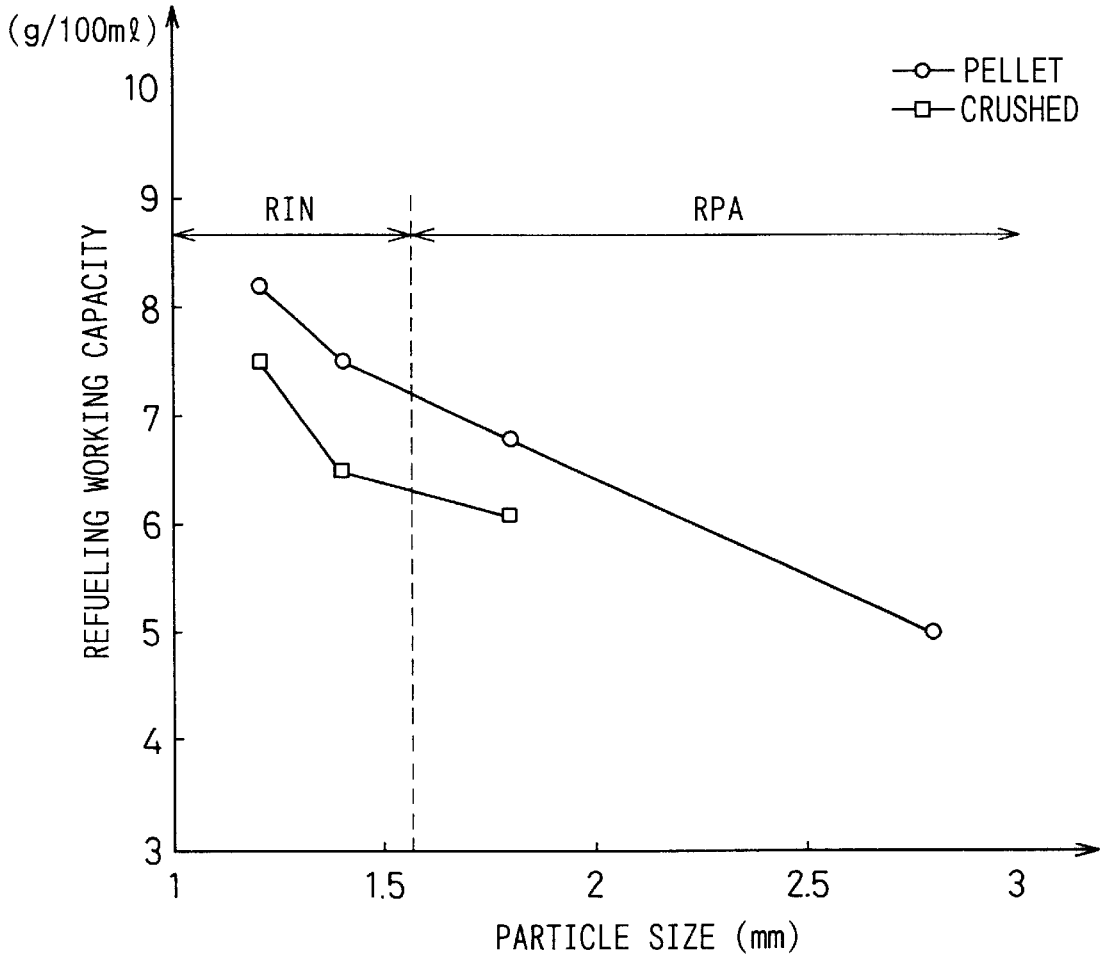
FIG. 8 is a graph showing refueling working capacities with respect to particle size of activated carbon.

When the engine is running and a negative pressure is available in the intake passage 8, that is the canister 1 desorbs adsorbed fuel vapor, the electric heater 17 is activated and the purge valve 6 is opened. The atmospheric air is drawn from the vent line 5 into the canister 1. The atmospheric air purges the adsorbed fuel vapor to the intake passage 8 via the purge line 7. The adsorbed fuel vapor is desorbed as shown in FIG. 6. The condensed fuel vapor adsorbed on the pore 111 is vaporized again and decreases temperature of the activated carbon particles 11. The electric heater 17 heats the activated carbon particles 11 to enhance desorption.

The activated carbon particles 11 are made of pellets. The activated carbon particles 11 have particle size of 1.2 mm (millimeters) in diameter. The particle size is measured by the screening method using screens defined by JIS Z 8801 (Japanese Industrial Standard). The activated carbon particles 11 have pore volume of 0.30 ml/ml (milliliters/milliliter). The pore volume is measured by the nitrogen adsorption Cranston-Inkley method. The activated carbon particles 11 have average pore size of 11.5 Angstroms in radius. The average pore size is measured by the nitrogen adsorption Cranston-Inkley method.

The activated carbon particles 11 may have another properties that satisfy the following conditions. The particle diameter is in a range of 1.0 mm to 1.6 mm. The particle size is measured by the screening method using screens defined by JIS Z 8801. The pore volume is 0.28 ml/ml or more. The pore volume is measured by the nitrogen adsorption Cranston-Inkley method. The average pore radius is in a range of 10.5 Angstroms to 12.0 Angstroms. The average pore size is measured by the nitrogen adsorption Cranston-Inkley method.

The activated carbon particles 11 may be made of crushed carbon particles. The activated carbon particles 11 may be made of columnar shaped pellets. In the cases of above, the particle diameter is represented by transversal diameter of the particles.

According to the embodiment, the canister 1 has the following advantages. The canister 1 provides high performance of adsorption when the activated carbon particles 11 adsorbs fuel vapor, since the activated carbon particles 11 has particle diameter of 1.2 mm (measured by the screening method), pore volume of 0.3 ml/ml (measured by the nitrogen adsorption Cranston-Inkley method), and average pore radius of 11.5 Angstroms (measured by the nitrogen adsorption Cranston-Inkley method).

Although desorption performance is not high due to relatively small average pore radius such as 11.5 Angstroms, the electric heater 17 enhances desorption performance for providing sufficient desorption performance.

Moreover, it is possible to prevent lowering of adsorption performance due to residual heat, since the activated carbon particles 11 have relatively small particle diameter of 1.2 mm that enables the activated carbon particles rapidly decreases temperature thereof from heated temperature for desorption.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A canister, comprising:

activated carbon particles contained in a canister container; and means for heating the activated carbon particles when the activated carbon particles are desorbed, wherein the activated carbon particles have pore volume of 0.28 ml/ml or more, and average pore radius which is in a range of 10.5 Angstroms to 12.0 Angstroms.

2. The canister of claim 1, wherein particle size of the activated carbon particles is in a range of 1.0 mm to 1.6 mm.

3. The canister of claim 2, wherein the particle size is defined by diameter.

4. The canister of claim 1, wherein the canister includes:

a first end portion which is communicated with a fuel tank via a vapor line, and is communicated with an intake passage of an engine via a purge line with a purge valve; and a second end portion in which purge air is drawn for purging the adsorbed vapor.

5. The canister of claim 2, wherein the canister includes:

a first end portion which is communicated with a fuel tank via a vapor line, and is communicated with an intake passage of an engine via a purge line with a purge valve; and a second end portion in which purge air is drawn for purging the adsorbed vapor.

6. The canister of claim 1, wherein the activated carbon particles are adsorptive of fuel vapor.

* * * * *